United States Patent [19]

Waters et al.

[11] 3,946,498

[45] Mar. 30, 1976

[54] PORTABLE HAIR DRYER

[75] Inventors: Robert S. Waters, Lancaster; Edward J. Doyle, Hatboro, both of Pa.

[73] Assignee: Schick Incorporated, Lancaster, Pa.

[22] Filed: July 31, 1974

[21] Appl. No.: 493,705

[52] U.S. Cl. ..... 34/99; 34/239; 219/372; 219/374

[51] Int. Cl.[2] ..... A45D 20/24

[58] Field of Search ..... 34/90, 91, 96–101, 34/103, 239; 132/9; 224/5 H, 5 N, 5 Y; 219/369–374; D86/10

[56] References Cited

UNITED STATES PATENTS

| | | | |
|---|---|---|---|
| 2,466,915 | 4/1949 | Shields | 34/99 |
| 2,834,866 | 5/1958 | Bentzman | 34/99 |
| 3,108,862 | 10/1963 | Toulmin | 34/99 |
| 3,377,715 | 4/1968 | Hubner | 34/99 |
| 3,383,700 | 5/1968 | Taylor | 34/99 |
| 3,726,021 | 4/1973 | Waters et al. | 34/99 |
| D155,482 | 10/1949 | Collison | 34/99 |

FOREIGN PATENTS OR APPLICATIONS

| | | | |
|---|---|---|---|
| 1,033,281 | 7/1953 | France | 34/99 |

*Primary Examiner*—John J. Camby
*Assistant Examiner*—James C. Yeung
*Attorney, Agent, or Firm*—Lockwood, Dewey, Zickert & Alex

[57] ABSTRACT

A portable hair dryer comprises a flexible bonnet, a combined blower and heater power module for supplying heated air under pressure to the bonnet, and a control module for selecting the operating mode of the dryer. The power module is suspended against the back of the user by means of a pair of support straps which extend over the user's shoulders to the control module. By balancing the weights of the power and control modules, a stable condition is obtained which enables the user to perform other activities during the drying operation. The power cord of the dryer depends from the control module to assist in balancing the weights, and flexible electrical conductors in one of the support straps convey electrical power to the power module. The other support strap is removably attached to the control module to facilitate setting up and taking down the appliance. The bonnet includes an internal air duct formed by seams between its inner and outer liners for directing air to a central distribution plenum, and a plurality of radially-extending passageways similarly formed for distributing air from this plenum to the surrounding portions of the bonnet for even heat flow.

21 Claims, 16 Drawing Figures

FIG. 12
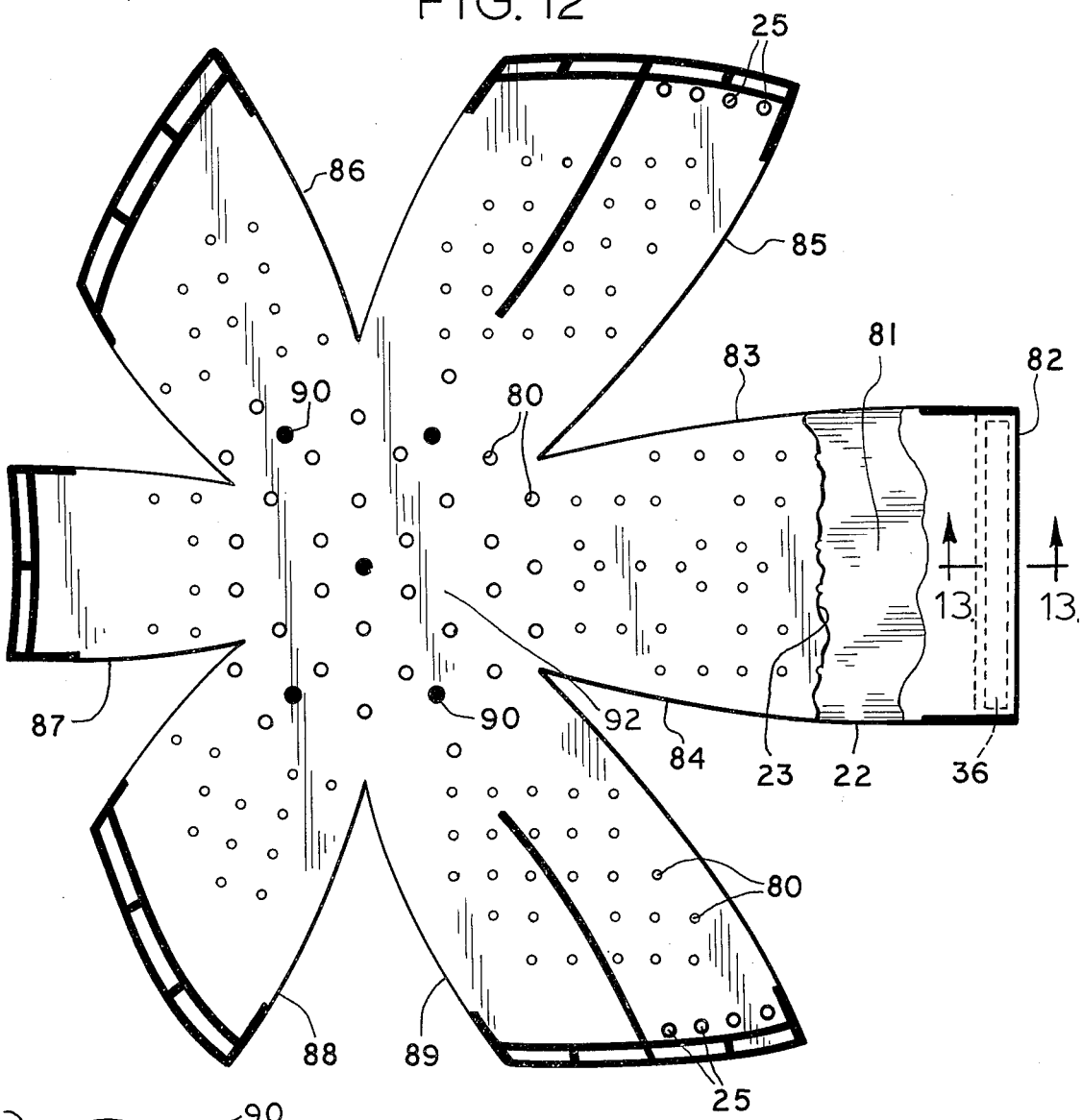
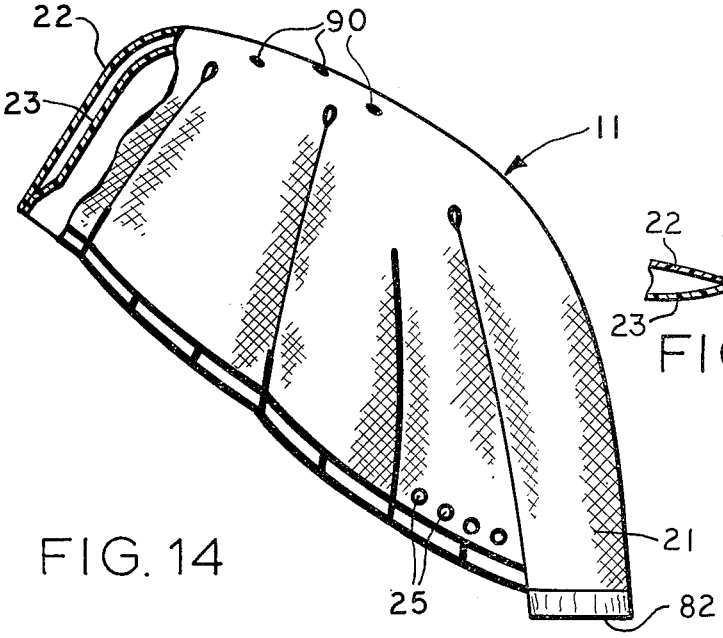
FIG. 14
FIG. 13
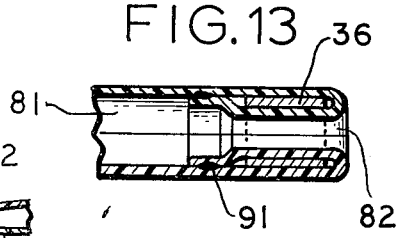
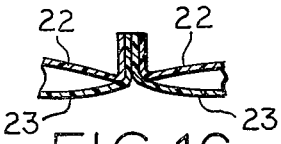
FIG. 16
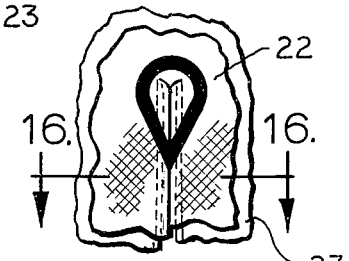
FIG. 15

PORTABLE HAIR DRYER

BACKGROUND OF THE INVENTION

The present invention relates generally to hair dryers, and more particularly to an improved bonnet-type hair dryer offering improved performance and convenience of use.

One factor which bears heavily on consumer acceptance of portable hair dryers for home use is the ease with which such hair dryers can be used. Preferably, the user should be free to perform other activities while the hair dryer is in use, and the set up and dismantling of the hair dryer prior to and after each use should not be unnecessarily difficult or time-consuming. Soft-hat or bonnet-type hair dryers, wherein a bonnet of flexible plastic material is fitted over the head of the user and connected by conduit means to an associated blower and heated power module, have proven popular for these reasons, since the light-weight bonnet frees the user from having to sit in a particular position and is easily put on and taken off by the user.

One disadvantage of prior art bonnet-type hair dryers has been the hose connection required between the bonnet and the power module for conveying heated air to the bonnet. This connection confines the user's activities to a relatively small area while the dryer is in operation, and exposes the power module, which necessarily has to be placed on a nearby supporting surface, to breakage should the user forget about the connecton between the bonnet and the power module and accidentally pull the power module off its supporting surface. Also, there is necessarily some heat loss in the flexible hose connection, so that optimum efficiency in such hair dryers is difficult to obtain.

Attempts at improving the convenience of use of bonnet-type hair dryers have centered on providing a power module integral with the bonnet, either supported solely by the bonnet, or by the bonnet and a brace extending to the shoulders and neck of the user. Those arrangements depending on the bonnet for support have not proved satisfactory because of inadequate support for the power module, which tended to shift position with movement of the user's head, creating a feeling of apprehension and general discomfort to the user. Those arrangements utilizing a brace to transfer a portion of the weight of the power module to the user also have not proved satisfactory, since the brace undesirably restricted movement of the user's head and the power module was still dependent on the flexible plastic material of the bonnet for stability.

Accordingly, it is a general object of the present invention to provide a new and improved portable hair dryer.

It is another object of the present invention to provide a new and improved portable hair dryer which because of its construction provides optimum comfort during use and requires a minimum amount of time and effort to set-up for use and disassemble for storage.

It is another object of the present invention to provide a new and improved portable bonnet-type hair dryer which provides improved efficiency and convenience of use.

It is another object of the present invention to provide a new and improved bonnet-type hair dryer which is simple in design and construction and which can be conveniently manufactured by known manufacturing techniques.

SUMMARY OF THE INVENTION

The invention is directed to a portable hair dryer which comprises a flexible bonnet adapted to fit over the head of a user for distributing air onto a hair surface to be dried, the bonnet having an inlet at one end for receiving heated air under pressure, and a combination blower and heater power module having a housing and an outlet in the housing for supplying heated air under pressure. Support strap means extending over the shoulders of the user are provided for supporting the combination blower and heater power module against the back of the user whereby the outlet is positioned adjacent to the inlet, and means for joining the outlet and the inlet are provided to form a substantially airtight passageway between the power module and the bonnet for supplying heated air to the bonnet.

The invention is further directed to a portable hair dryer comprising a flexible bonnet including inner and outer layers joined to form an air distribution chamber over the head of a user, the bonnet including a rearwardly and downwardly extending portion forming a receiving duct for heated air. A combination blower and heater power module is provided for supplying heated air under pressure, the module including an upwardly extending air outlet portion adapted to engage the rearwardly-extending portion of the bonnet.

The hair dryer further comprises a control module comprising a housing and a user-actuable mode switch mounted on the housing, and support means comprising a pair of support straps attached to the power module housing and extending over the shoulders of the user to the control module for supporting the control module against the chest of the user, and the power module against the back of the user whereby the outlet portion of the power module is positioned for engagement with the inlet portion of the bonnet to supply heated air to the bonnet.

The invention is further directed to a portable hair dryer of the type comprising a combination blower and heater power module including a housing having an upwardly projecting air discharge duct, to a bonnet for distributing heated air from the blower assembly to the head of a user. The bonnet comprises a first at least partially perforate sheet of flexible material dimensioned and formed to form a dome-shaped enclosure over the hair surface of the user, and a second substantially inperforate sheet of flexible material corresponding in dimensions and form to the first sheet and adapted to extend over the outer surface of the dome-shaped enclosure formed thereby. Means are provided for forming a substantially airtight seal between the first and second sheets along substantially their entire margins excepting a defined fractional inlet portion thereof to form an air distribution plenum therebetween. Means are further provided for forming additional radially-extending seals between the first and second sheets extending from an air distribution area located between and near the center of the sheets to the margins, two of the seals extending to respective ends of the defined inlet portion of the margins to direct air received at the inlet portion to the central location to obtain improved air distribution from the bonnet.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

FIG. 12 is a top elevational view of the inner and outer liners forming the flexible bonnet portion of the hair dryer.

FIG. 13 is an enlarged cross-sectional view taken along lines 13—13 of FIG. 12 showing the margins of the inlet portion of the bonnet.

FIG. 14 is a side elevational view of the assembled bonnet partially broken away to show the air distribution plenum formed between the inner and outer liners.

FIG. 15 is an enlarged front elevational view showing the construction of the seams which join the inner and outer liners.

FIG. 16 is a cross-sectional view of the seams taken along lines 16—16 of FIG. 15.

DESCRIPTION OF THE PREFERRED EMBODIMENT

Figure 1:
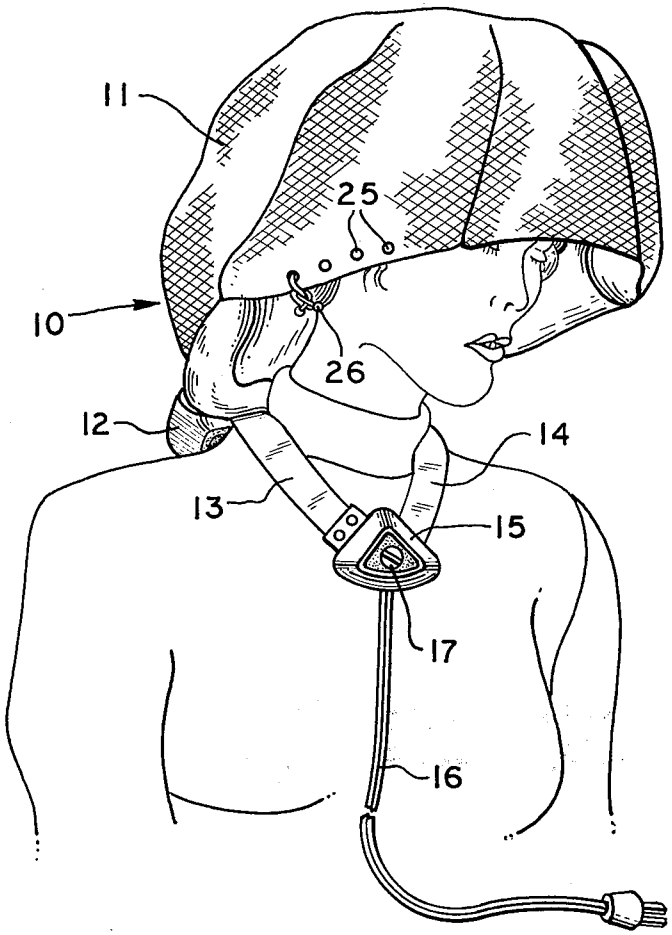
FIG. 1 is a perspective view of a hair dryer constructed in accordance with the invention in position on the head of a user.

Referring to FIG. 1, a hair dryer 10 constructed in accordance with the present invention is seen to comprise a soft bonnet 11 dimensioned to encompass the hair surface to be dried, a combined heater and blower power module 12 suspended by support straps 13 and 14 over the shoulders of the user, and a control module 15 connecting the front ends of the support straps. Power is supplied to the hair dryer by means of a power cord 16 which enters the appliance through the bottom end of the control module 15. A control knob 17, readily available to the user, is provided on the front face of module 15 to permit user selection of the operating mode of the hair dryer.

Figure 3:
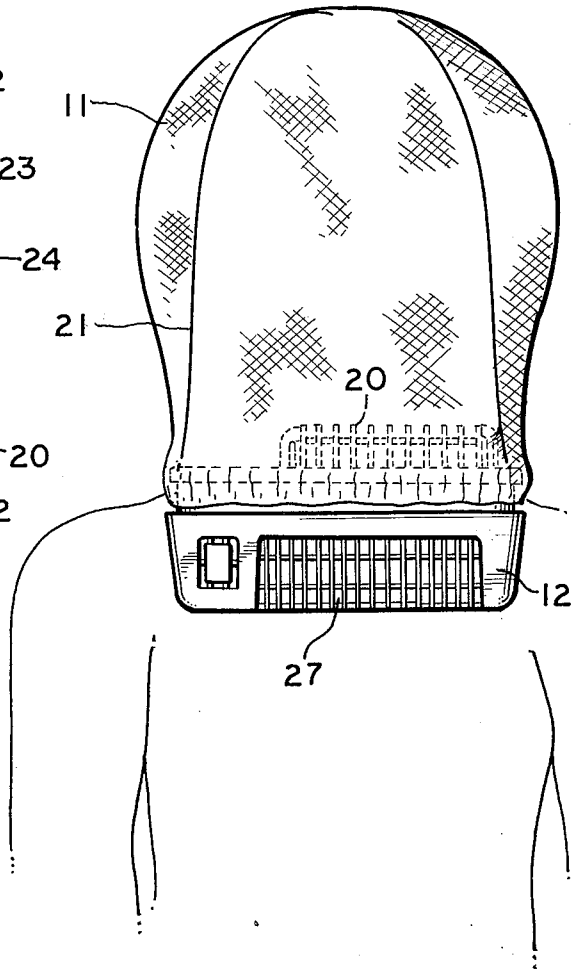
FIG. 3 is a rear elevational view of the hair dryer of FIG. 1.
Figure 2:
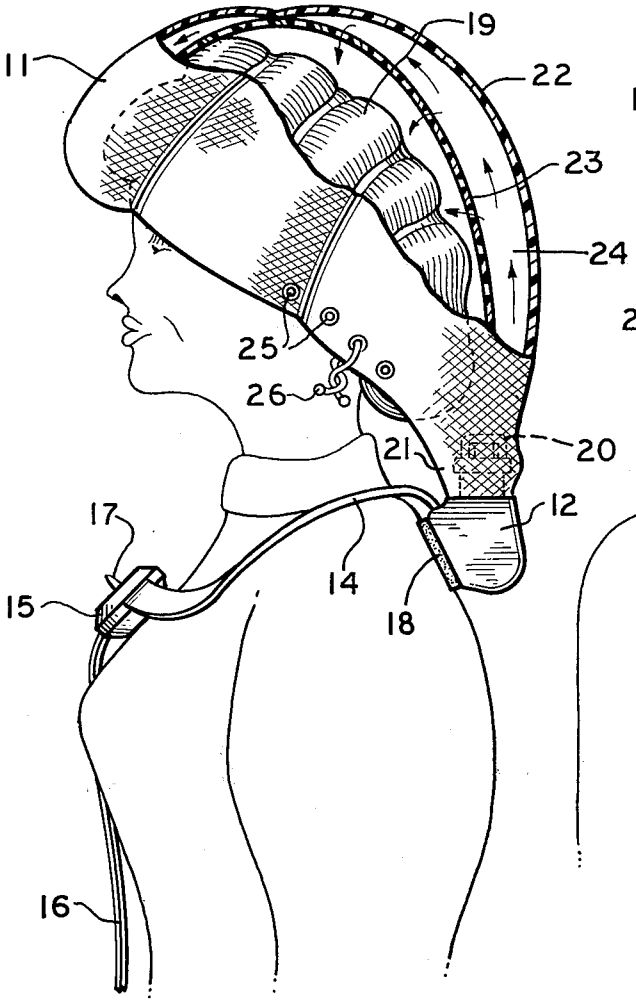
FIG. 2 is a side elevational view of the hair dryer of FIG. 1 partially in section to show the air distribution plenum formed within the bonnet portion thereof.

As shown in FIGS. 2 and 3, the power module 12 is supported by straps 13 and 14 so as to lie against the back of the user, immediately below the user's neckline. A pad 18 of soft resilient material such as foam rubber is provided on module 12 at the point where it rests against the back for increased comfort and to help stabilize the position of the module. Module 12 is also provided with an upwardly-extending outlet portion 20 adapted to receive a downwardly-extending inlet portion 21 of bonnet 11. This forms a duct or conduit through which heated air from power module 12 is conveyed to the bonnet for discharge onto the underlying hair surface 19. To this end, the bonnet may be formed from an imperforate outer layer 22 and a perforated inner layer 23 of flexible plastic material to form a plenum 24 for the heated air through which the air is directed onto the hair surface. An inlet 27 may be provided at the rear of power module 12 for drawing in ambient air to be heated and discharged under pressure to bonnet 11.

To accommodate different sized heads a plurality of eyelets 25 may be provided adjacent the margins of bonnet 11 on either side of the bonnet. By bunching the margins of the bonnet at these eyelets, and then placing a fastener such as the conventional twist-lock clip 26 shown in FIGS. 1 and 2 through these eyelets, the circumference of the bonnet can be effectively reduced to fit smaller heads.

Figures 4, 5:
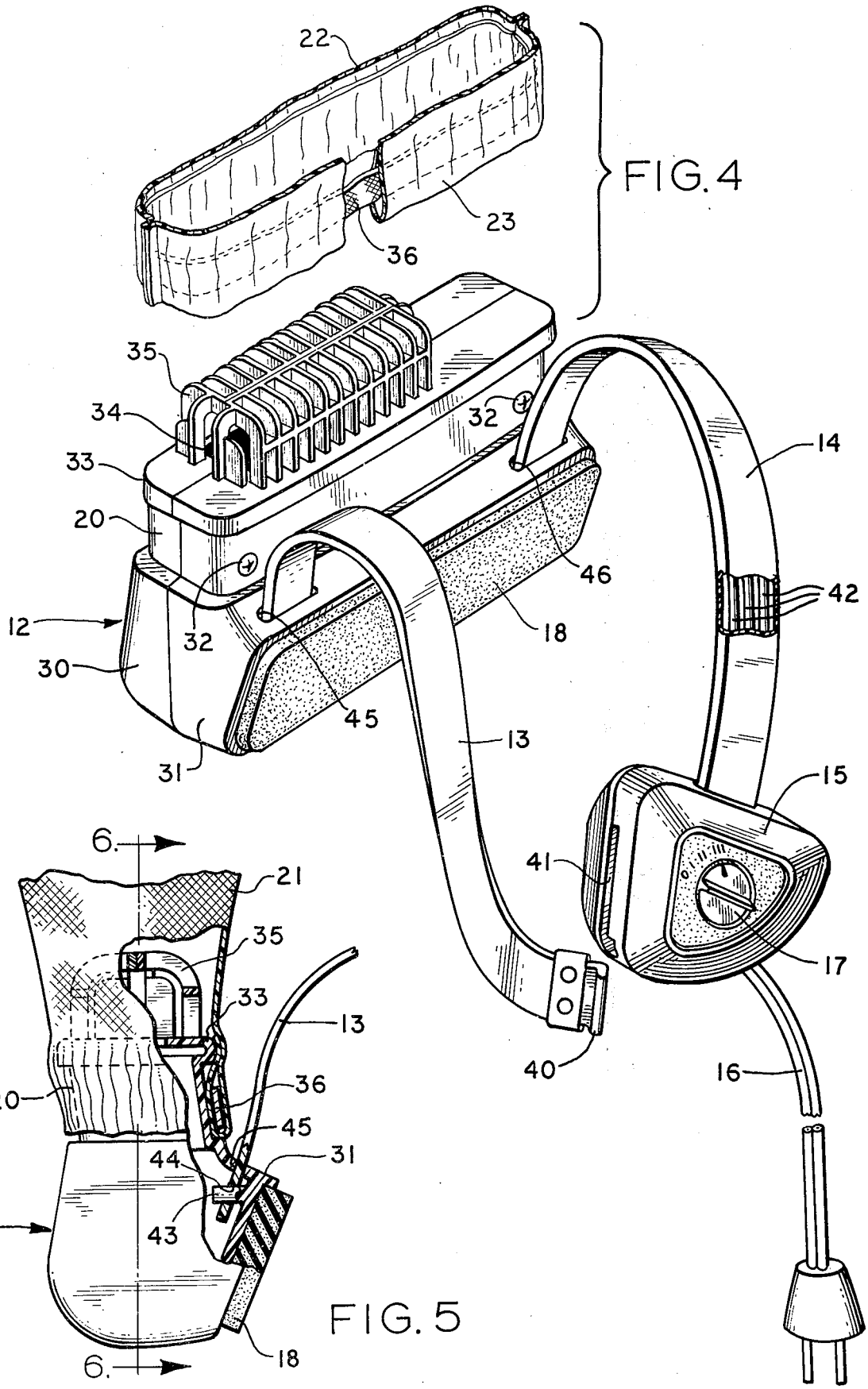
FIG. 4 is a perspective view of the hair dryer showing the power and control modules, support straps, and power cord thereof.
FIG. 5 is a side elevational view of the power module with the inlet portion of the bonnet attached, partially broken away to show the means employed for attaching the support straps.

Referring to FIG. 4, the housing of the combined blower and heater power module 12 is formed by two sections 30 and 31 fastened together by means in the form of machine screws 32 which extend between the two sections. The outlet portion 20 of the power module is seen to include a lip 33 around its end surface, and a rectangular aperture 34 in its end surface forming a discharge port through which heated air is discharged under pressure. An outwardly projecting grill 35 is provided over aperture 34 for the purpose of preventing the inlet portion of the bonnet from being inadvertently pulled across discharge port 34 so as to block the flow of air therefrom and possibly overheat the power module. The lip 33 serves to define a region immediately inwardly adjacent thereof on outlet portion 20 for engaging the inlet portion 21 of bonnet 11. To obtain an airtight but easily separable coupling between these two elements, the margins of the outer layer 22 and inner layer 23 of bonnet 11 may be folded back over an elastic band 36 to form a resilient neck assembly which can be slipped over lip 33 by the user onto outlet portion 20 as shown in FIGS. 5–7.

Support strap 13 is removably attached to control module 15 by means of a tongue-and-groove fastening arrangement comprising a tongue fastener 40 on strap 13 and a complementarily shaped and dimensioned groove 41 molded into the side of the housing of control module 15. The other support strap 14 is permanently attached to module 15 and includes three electrical conductors 42 for conveying electrical power from the control module to the power module.

As shown in FIG. 5, the two support straps 13 and 14 are attached to module 12 by means of retaining studs 43 molded onto the inside surface of housing section 12. These studs extend through apertures 44 provided near the ends of support straps 13 and 14 to prevent the straps from pulling free. A pair of slots 45 and 46 (FIG. 4) are provided in housing section 31 immediately above pad 18 to accommodate support straps 13 and 14, respectively.

Figure 6:
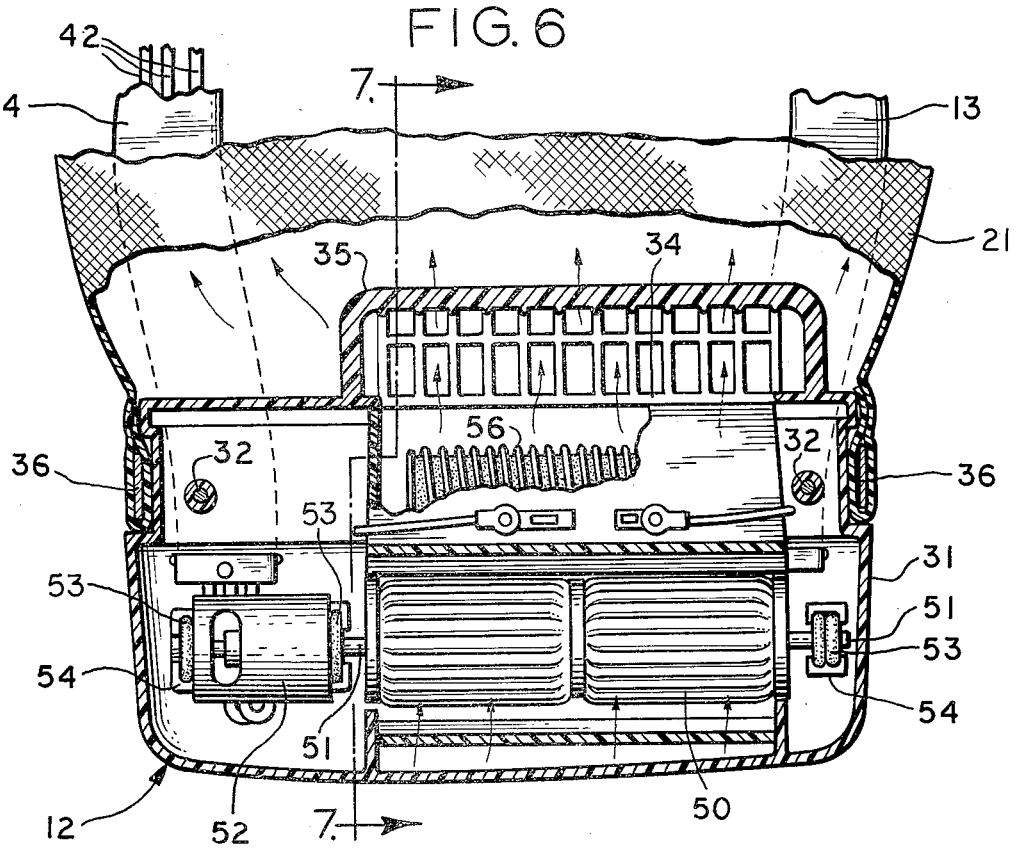
FIG. 6 is a cross-sectional view of the power module taken along lines 6—6 of FIG. 5.
Figure 7:
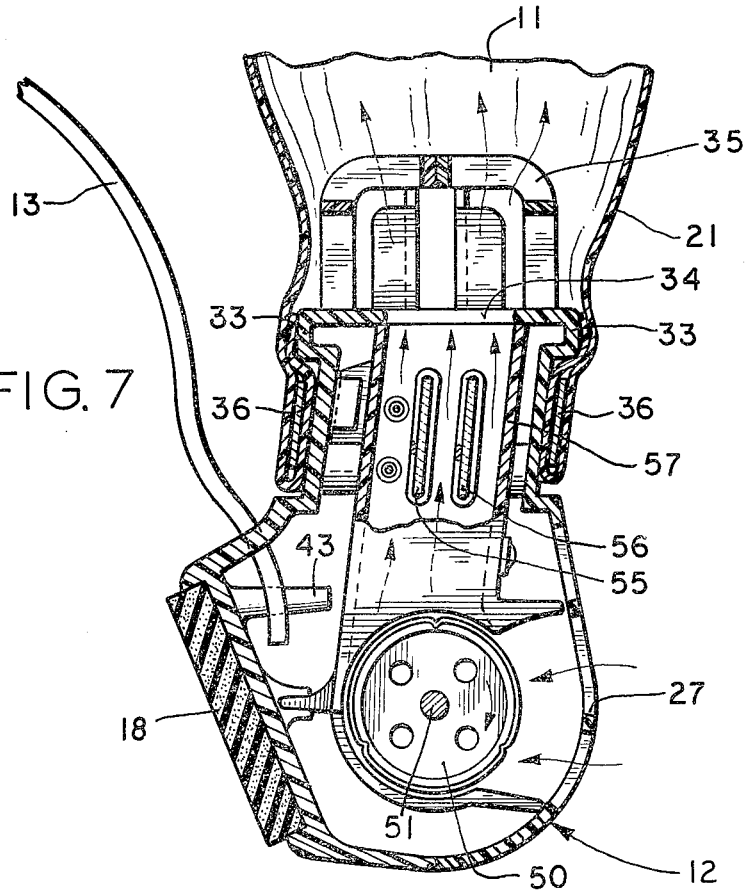
FIG. 7 is a cross-sectional view of the power module taken along lines 7—7 of FIG. 6.

Referring to FIGS. 6 and 7, the blower and heater power module 12 is seen to include a cross-flow type fan 50 rotatably supported on a shaft 51 and aligned so as to draw air in through inlet 27 and discharge air through outlet port 34. Fan 50 is rotatably driven by a motor 52, which may be a conventional permanent magnet type DC motor of suitable capacity. Shaft 51 is preferably mounted to housing sections 30 and 31 by means of a plurality of rubber grommets 53 which are seated in approximately positioned flanges 54 molded into the interior surfaces of the housing sections.

A pair of electrical resistance-type heating elements 55 and 56 are provided in power module 12 for heating the air to a sufficient temperature for drying the user's hair. An internal baffle 57 is provided within module 12 to direct air flow from inlet 27 to fan 50, from fan 50 to heating elements 55 and 56, and from elements 55 and 56 to discharge port 34. The heating elements are preferably disposed edgewise to the flow path of the air for optimum heat transfer.

Figure 8:
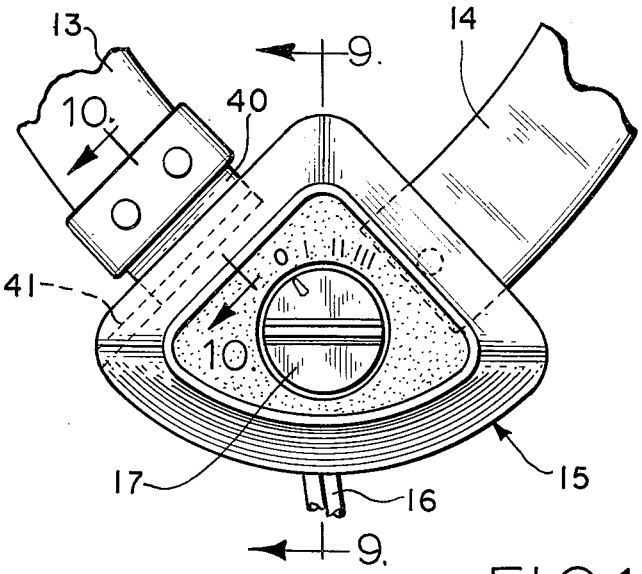
FIG. 8 is an enlarged front elevational view of the control module with support straps attached.
Figure 9:
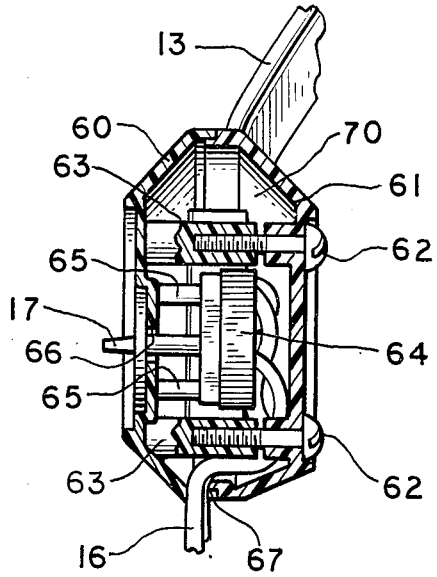
FIG. 9 is a cross-sectional view of the control module taken along lines 9—9 of FIG. 8.
Figure 10:
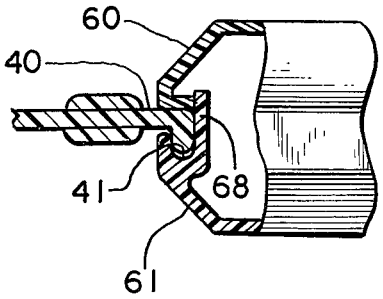
FIG. 10 is an enlarged cross-sectional view taken along lines 10—10 of FIG. 8 illustrating the tongue-and-groove attachment of the left support strap to the control module.
Figure 11:
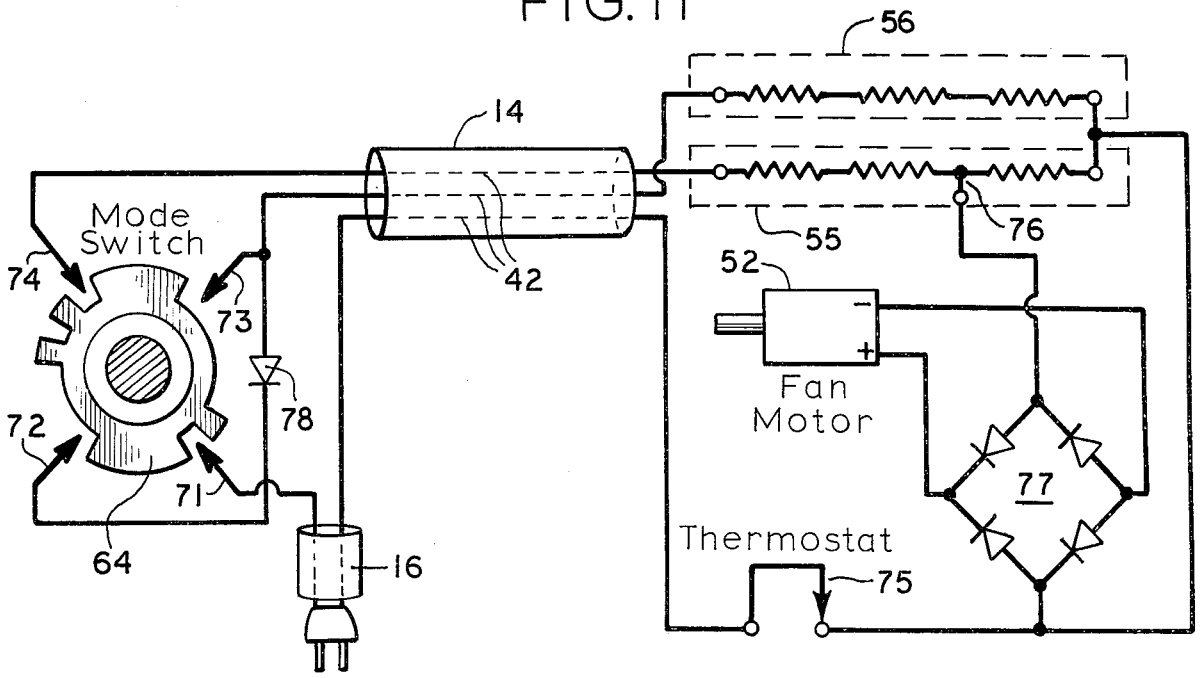
FIG. 11 is a schematic diagram of the electrical wiring of the hair dryer.

Referring to FIGS. 8–10, the control module 15 associated with hair dryer 10 comprises two housing sections 60 and 61. These sections are joined by fastening means in the form of a pair of machine screws 62 which extend through apertures in section 61 and into complementarily threaded studs 63 on the inside surface of section 60. A four position operating mode selection switch 64 is mounted to the inside surface of section 60 by means of mounting posts 65 projecting therefrom. The shaft of switch 64 extends through an aperture 66 in housing section 60 and into operative engagement with control knob 17. The electrical power cord 16 enters an aperture 67 provided in the bottom of housing sections 60 and 61.

Support strap 13, as previously described, includes a tongue fastener 40 which engages a complementarily dimensioned groove 41 provided along one edge of control module 15. As shown in FIG. 10, the groove 41 is formed between housing sections 60 and 61, a recess 68 being provided in housing section 61 to form the rear wall of the groove. By reason of this tongue and groove latching arrangement the hair dryer can be quickly and conveniently removed from the user's head. This is a particular convenience where the hair drying operation must be momentarily interrupted and where the user intends to return shortly and resume the drying operation.

For optimum user comfort it is desirable that the weights of the back-mounted blower and heater power module 12 and the front-mounted control module 15 be balanced. To this end one of more weights 70 may be provided in the interior of control module 15 so that the weight of control module 12 coupled with the downward pull of power cord 16 approximately equals the weight of the power module 12 as it rests against the back of the user with bonnet 11 in position. As a result, a balanced condition is achieved wherein the hair dryer rests squarely and securely on the shoulders of the user with no tendency to slide either forwardly or rearwardly. This contributes to a sense of freedom for the user, since the user need take no conscious action to maintain the hair dryer in position.

While it will be appreciated that the hair dryer of the present invention can be constructed to operate at many different blower speeds and heat levels, it has been found in practice that a single-speed three-heat level capability is adequate for almost all hair drying applications. Accordingly, hair dryer 10 has been provided with electrical circuitry for operating at three different heat levels (LOW, MEDIUM and HIGH) with a single blower speed. Referring to the schematic diagram of FIG. 10, one side of the AC line (as represented by power cord 16) is connected to a first contact 71 on mode selection switch 64 in control module 15. The other side of the AC line is connected directly through a first one of the conductors 42 in support strap 14 to one terminal of an electrical thermostat 75 contained in the power module 12. When mode selection switch 64 is positioned for operation in the LOW HEAT mode, contact 71 is connected to a second contact 74 on the switch and current flows through a second one of conductors 42 in support strap 14 to one end terminal of heating element 55. The other end terminal of heating element 55 is connected to thermostat 75 to complete a circuit whereby line voltage is impressed across heating element 55 only.

Heating element 55, which consists of three individual series-connected resistance elements, includes a tap 76 between its second and third resistance elements for deriving that portion of the AC line voltage impressed across the entire heating element 55 which appears across the third resistance element. This derived AC voltage is impressed across the input terminals of a bridge rectifier network 77 to develop a unidirectional current for application to fan motor 52. Thus, in the LOW HEAT operating mode of hair dryer 10 only heating element 55 and fan motor 52 are powered.

In the MEDIUM HEAT position of mode selection switch 64 a third contact 72 is connected to contact 71 in addition to contact 74. This causes current to flow through a diode 78 to one end terminal of heating element 56, which like heating element 55 is composed of three separate series-connected resistance elements. The other end terminal of heating element 56 is connected to thermostat 75, so that AC line current is supplied through diode 78 to heating element 56. Although diode 78 has the effect of allowing only alternate half cycles of the AC line to power heating element 56, the net effect of this partial energization of heating element 56 combined with the continued full energization of heating element 55 is that the air discharged from power module 12 is substantially hotter than that discharged when only heating element 55 was energized.

In the HIGH HEAT position of mode selection switch 64 a contact 73 is connected to contact 71 in addition to contacts 72 and 74, effectively bypassing diode 78. As a result, both half cycles of the applied AC line energize heating element 56 to heat that element fully. As a result, the air discharged by power module 12 is still hotter than that obtained previously in the MEDIUM HEAT mode when heating element 56 was only partially energized. In all three modes it should be noted that the speed of fan motor 52 remains substantially constant since heating element 55 from which the fan motor derives its operating power is always fully energized.

The purpose of thermostat 75 is to remove power from the heating elements and fan motor should module 12 overheat. To this end the thermostat is placed within the power module housing in thermal communication with the heating elements and heated air stream.

Referring now to FIG. 12, the outer liner 22 and inner liner 23 of bonnet 11 are each cut in a star-like pattern having six radially extending arcuately terminated elongated legs 84–89 prior to being joined to form the bonnet shown in FIGS. 1–3. The inner liner 23 is provided with a plurality of apertures 80 of various sizes to distribute air onto the hair surface of the user, and the outer liner 22 is imperforate.

To provide uniform distribution of the heated air from power module 12, the outer and inner liners 22 and 23 are sealed together along the side margins 83 of the rearwardly-extending leg 84 to form an air duct 81 in that leg between the liners. As detailed previously, the end margins of this duct are not sealed, but are instead folded back over the resilient band 36 and sealed at 91 as illustrated in FIG. 13 to form an inlet port 82 through which heated air is fed to the bonnet. The passageway 81 directs air from inlet port 82 to a distribution plenum 92 located at a predetermined position near the center of the bonnet. Since the margins 83 of leg 84 are sealed, a large portion of the air entering through inlet port 82 is conveyed to the central plenum location. To uniformly distribute the air received in the central distribution plenum 92 the edges of the other radially-extending legs 85-89 are similarly joined along their edges to form radially-extending distribution ducts for evenly distributing air as it flows away from the central plenum. By reason of this novel arrangement of passageways between the inner and outer liners, hot spots, i.e. areas of excessively high air temperature, are avoided. In practice the size, location and number of the apertures 80 are arranged to achieve an even distribution of air under the hood as it flows through the feeder duct 81 and the various distribution ducts formed in the five distribution legs 85–89. The margins of legs 84–89 are joined as illustrated in FIGS. 15 and 16 to form the familiar hood-shaped bonnet 11. Basically, this is accomplished by positioning the four adjacent edges side-by-side and applying sufficient heat to form a single seam on the inside surface of the bonnet. The eyelets 25, previously identified as a means for adjusting the size of the bonnet to accommodate different head sizes, extend through both liners 22 and 23. The two liners may also be joined in the area of the central distribution plenum 92 at one or more points 90 for increased rigidity.

In operation, it is merely necessary to attach bonnet 11 to power module 12, position the power module behind the neck, and attach support strap 13 to control module 15. Bonnet 11 is then fitted over the hair, the power cord 16 is plugged in, and the desired heat level is selected. The user can then perform other activities heretofore impossible with prior art designs, since the only limitation on movement is the length of power cord 16, which may be extended to almost any desired length. To momentarily interrupt the drying operation, as for answering the telephone, it is merely necessary to turn the mode control knob 17, conveniently located in front of and in sight of the user, to OFF and remove bonnet 11 by allowing it to hang out of the way along the back from power module 12. Operation can then be quickly resumed by replacing the bonnet and resetting the control knob.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A portable hair dryer comprising, in combination:

a flexible bonnet adapted to fit over the head of a user for distributing air onto a hair surface to be dried, said bonnet having an inlet at one end for receiving heated air under pressure;

a combination blower and heater power module having a housing and an outlet in said housing for supplying heated air under pressure;

support means including a pair of straps adapted to extend over the shoulders of the user and join in front of the user for supporting said combination blower and heater power module against the back of the user whereby said outlet is positioned adjacent to said inlet; and means for joining said outlet and said inlet to form a substantially airtight passageway between said power module and said bonnet for supplying heated air to said bonnet.

2. A hair dryer as defined in claim 1 wherein said bonnet is formed from a substantially imperforate outer layer and a perforated inner layer, and said layers are joined along substantially their entire margins to form an air distribution plenum.

3. A hair dryer as defined in claim 2 wherein said inlet on said bonnet includes an expandable margin dimensioned to fit snugly over said outwardly-extending portion of said housing.

4. A hair dryer as defined in claim 1 wherein said support straps are joined by a control module having a housing and a user-actuable mode selection switch, and wherein said control module is suspended by said straps in front of the user.

5. A hair dryer as defined in claim 4 wherein at least one of said support straps is detachable from said control module to facilitate removal of said power module and bonnet from the user.

6. A hair dryer as defined in claim 4 wherein said hair dryer includes a power cord for supplying power to said power module, said power cord depending from said control module to assist in counterbalancing the weight of said power module while supported over the shoulders of the user.

7. A portable dryer comprising, in combination:

a flexible bonnet including a perforate inner and a substantially imperforate outer layer joined to form an air distribution chamber over the head of a user, and having a rearwardly extending portion forming a receiving duct for heated air under pressure;

means including a combination blower and heater power module for supplying heated air under pressure to said bonnet, said module including an upwardly extending air outlet adapted to engage said rearwardly extending portion of said bonnet; and support means including a pair of straps attached to said housing and adapted to extend over the shoulders of the user and to be joined at the front of the user for supporting said power module against the back of the user whereby said outlet is positioned for engaging said inlet to supply heated air to said bonnet.

8. A hair dryer as defined in claim 7 wherein said power module includes a housing, said housing includes a projecting portion forming a discharge duct for conveying air to said bonnet, and said inlet portion of said bonnet includes means for engaging said projecting portion to form a substantially airtight seal therewith.

9. A hair dryer as defined in claim 8 wherein said projecting portion of said power module includes a discharge port having margins at the end of said projecting portion and an outwardly projecting grill extending between said margins to prevent said inner and outer layers of said connet from being drawn together across said port.

10. A hair dryer as defined in claim 7 wherein said power module housing includes an outwardly projecting spacer portion for engaging the back of the user to maintain said power module at a predetermined spacing therefrom and said air plenum portion extending upwardly.

11. A hair dryer as defined in claim 1 wherein said spacer portion has a padded surface for contacting the back surface of the user.

12. A hair dryer as defined in claim 7 wherein each of said support straps include an aperture at one end and wherein said power module housing includes integral molded pins extending through said apertures to attach said support straps to said housing.

13. A portable hair dryer comprising, in combination:

a flexible bonnet including inner and outer layers joined to form an air plenum over the head of a user, said bonnet including a rearwardly and downwardly extending portion forming an inlet into said plenum for heated air;

a combination blower and heater power module assembly for supplying heated air under pressure, said assembly including an upwardly extending air outlet portion adapted to engage said rearwardly-extending portion of said bonnet;

a control module including a housing and a user-actuable mode switch mounted on said housing; and support means including a pair of support straps attached to said power module housing and adapted to extend over the shoulders of the user to said control module for supporting said control module against the chest of the user and said power module against the back of the user whereby said outlet portion of said assembly is positioned for engagement with said inlet of said bonnet to supply heated air to said bonnet.

14. A hair dryer as defined in claim 13 wherein at least one of said straps is removably attached to said control module housing to facilitate removing said hair dryer from the head of the user.

15. A hair dryer as defined in claim 14 wherein the free end of said removable strap and said control module housing include mating fastening elements, one of said elements comprising a slot and the other of said elements comprising a tongue adapted to be slidably received within said slot.

16. A hair dryer as defined in claim 13 wherein at least one of said support straps includes flexible electrical conducting elements for conducting electrical current between said control module and said power module.

17. A hair dryer as defined in claim 16 wherein one of said support straps is removably attached to said control module housing and said conducting elements are contained in the other of said support straps.

18. A hair dryer as defined in claim 16 wherein said hair dryer includes a power cord depending from said control module housing.

19. A hair dryer as defined in claim 13 wherein said bonnet includes an air inlet duct formed in said plenum by radially-extending seals between said inner and outer layers for ducting air from said inlet to a distribution portion of said plenum located near the center of said bonnet.

20. In a portable hair dryer of the type comprising a combination blower and heater power module including a housing having an upwardly projecting air discharge duct, a bonnet for distributing heated air from said blower assembly to the head of a user, comprising, incombination:

a first at least partially perforate sheet of flexible material dimensioned and formed to form a dome-shaped enclosure over the hair surface of a user;

a second substantially imperforate sheet of flexible material substantially corresponding in dimensions and form to said first sheet;

said first and second sheets being sealed along substantially their entire margins to form an air plenum therebetween, said plenum including an inlet for receiving heated air from said module; and means including an air inlet duct formed by a pair of spaced-apart seals between said first and second sheets extending radially from a central distribution portion of said plenum to said inlet for directing air from said inlet to said central distribution portion.

21. A bonnet as defined in claim 20 which further comprises means including at least one additional seal between said first and second sheets extending radially from said central air distribution portion for forming air distribution ducts for directing air from said central distribution portion to radially adjoining portions of said plenum.

* * * * *